US012583489B2

(12) United States Patent
Ghouse et al.

(10) Patent No.: US 12,583,489 B2
(45) Date of Patent: Mar. 24, 2026

(54) SIDEWALL SUITABLE FOR A GANGWAY AND GANGWAY

(71) Applicant: Dellner Couplers AB, Falun (SE)

(72) Inventors: Mohammed Ghouse, Kanchipuram (IN); Sowthri Ganth Selvakumar, Erode (IN); Uwe Lauschke, Magdeburg (DE)

(73) Assignee: Dellner Couplers AB, Falun (SE)

( * ) Notice: Subject to any disclaimer, the term of this patent is extended or adjusted under 35 U.S.C. 154(b) by 931 days.

(21) Appl. No.: 17/858,895

(22) Filed: Jul. 6, 2022

(65) Prior Publication Data

US 2023/0041127 A1 Feb. 9, 2023

(30) Foreign Application Priority Data

Jul. 7, 2021 (EP) ..... 21184253
Oct. 7, 2021 (EP) ..... 21201459

(51) Int. Cl.
*B61D 17/20* (2006.01)

(52) U.S. Cl.
CPC ..... *B61D 17/20* (2013.01)

(58) Field of Classification Search
CPC ..... B61D 17/20; B60D 5/00
See application file for complete search history.

(56) References Cited

U.S. PATENT DOCUMENTS 11,255,897 B2 * 2/2022 Ghouse ..... H05K 1/181
11,479,272 B2 * 10/2022 Lauschke ..... B60D 5/003
11,745,772 B2 * 9/2023 Lauschke ..... B60D 5/006 105/8.1
12,220,956 B2 * 2/2025 Ghouse ..... B60D 5/00
2020/0361264 A1 * 11/2020 Fowler ..... B60D 5/003
2023/0041127 A1 * 2/2023 Ghouse ..... B60D 5/00

FOREIGN PATENT DOCUMENTS

BR 102015027925 A2 * 10/2016 ..... B61D 17/20
CN 207060049 U * 3/2018
DE 102017102525 A1 * 8/2018 ..... B61D 17/22
FR 3096949 A1 * 12/2020 ..... B61D 17/20

* cited by examiner

*Primary Examiner* — Jason C Smith

(74) *Attorney, Agent, or Firm* — Howard IP Law Group

(57) ABSTRACT

A sidewall for a gangway comprises a central main panel having a front side and a back side, a first side panel arranged to partially extend from a first side of the central main panel, the first side panel having a front side and a back side, wherein a part of the front side of the first side panel is arranged facing the back side of the central main panel. A second side panel is arranged to partially extend from a second side of the central main panel, opposite to the first side of the central main panel, a part of the front side of the first side panel being arranged facing the back side of the central main panel. At least one connection rod is provided, whereby a first connection is provided that connects the connection rod to the back of the first side panel, a second connection is provided that connects the connection rod to the back of the central main panel, and a third connection is provided that connects the connection rod to the back of the second side panel.

13 Claims, 10 Drawing Sheets

SIDEWALL SUITABLE FOR A GANGWAY AND GANGWAY

FIELD OF THE INVENTION

The invention pertains to a sidewall for gangway. The invention also pertains to a gangway. The invention also pertains to a multi-car vehicle with a first car and a second car.

BACKGROUND

From EP 2 308 736 B1 a sidewall for a gangway is known, whereby the sidewall comprises a first panel having a front side and a back side and a second side panel arranged to partially extend from a first side of the first panel, the second side panel having a front side and a back side, a part of the front side of the second side panel being arranged facing the back side of the first panel. In the design of EP 2 308 736 B1 a connection rod is provided, whereby a first connection is provided that connects the connection rod to the back of the first panel and a second connection is provided that connects the connection rod to the back of the second side panel. The sidewall known from EP 2 308 736 B1 has difficulties in situations of roll, for example, when the first car of a multi-car vehicle and the second car of a multi-car vehicle that are joined by a gangway that comprises the sidewall of EP 2 308 736 B1 rotate into opposite rotational directions about a common longitudinal axis (the longitudinal axis of the multicar vehicle).

SUMMARY

The problem to be solved by the invention is to provide a sideway for a gangway that is better adapted to different driving conditions of the multi-car vehicle that contains the gangway.

This problem is solved by one or more of a sidewall, gangway and multi-car vehicle according to embodiments and aspects of the present disclosure. Preferred embodiments are discussed in description following hereafter.

Embodiments or aspects of the invention work with the basic idea to provide the sidewall with a. a central main panel having a front side and a back side, b. a first side panel arranged to partially extend from a first side of the central main panel, the first side panel having a front side and a back side, a part of the front side of the first side panel being arranged facing the back side of the central main panel, c. a second side panel arranged to partially extend from a second side of the central main panel, opposite to the first side of the central main panel, a part of the front side of the second side panel being arranged facing the back side of the central main panel.

According to an aspect of the invention, the number of panels of the sidewall is increased, which at the cost of having to use a larger number of parts provides the advantages of more flexibility of the relative movements between the panels and thereby increases the way the sidewall can adapt to out of the straight conditions of the gangway. In the preferred design of the invention that as regards the numbers of panels consist of the central main panel, the first side panel and the second side panel furthermore leads to an arrangement that is more symmetric than the design known from EP 2 308 736 B1, which is advantageous in several ways, one of them being the better control of the relative movement of the panels relative to one another.

In a preferred embodiment, the sidewall has a first side panel that provides the first gangway end and has a second side panel that provide the second gangway end. In a preferred embodiment, the first side panel is moveable relative to the second side panel. In a preferred embodiment, the sidewall has an operational condition in which the first side panel and the second side panel are arranged parallel to each other. In a preferred embodiment, the sidewall has a height direction. In a preferred embodiment the first side panel has a height direction and the second side panel has a height direction. In a preferred embodiment, the sidewall has an operational condition in which the height direction of first side panel is parallel to the height direction of the second side panel and preferably is parallel to the height direction of the sidewall.

In a preferred embodiment, the central main panel is moveable relative to the first side panel and/or the second side panel. In a preferred embodiment, the sidewall has an operational condition in which the central main panel, first side panel and the second side panel are arranged parallel to each other. In a preferred embodiment, the sidewall has a height direction. In a preferred embodiment the first side panel has a height direction and the second side panel has a height direction and the central main panel has a height direction. In a preferred embodiment, the sidewall has an operational condition in which the height direction of first side panel is parallel to the height direction of the second side panel and the height direction of the central main panel and preferably is parallel to the height direction of the sidewall.

In a preferred embodiment the first side panel has a height, the height being understood as the maximum extend of the first side panel into the height direction. In a preferred embodiment, the first side panel has a width, the width being understood as the maximum extend of the first side panel into a width direction, the width direction being perpendicular to the height direction. In a preferred embodiment, the first side panel has a thickness, the thickness being understood as the maximum extend of the first side panel into a thickness direction, the thickness direction being perpendicular to the height direction and perpendicular to the width direction.

In a preferred embodiment the height of the first side panel is larger than the width of the first side panel, preferably by a factor of more than 1.2, more preferably by a factor of more than 1.5, more preferably by a factor of more than 2. In a preferred embodiment the width of the first side panel is larger than the thickness of the first side panel, preferably by a factor of more than 2, more preferably by a factor of more than 5, more preferably by a factor of more than 10. In a preferred embodiment the height of the first side panel is larger than the width of the first side panel, whereby the width is larger than the thickness of the first side panel.

In a preferred embodiment the first side panel is a rectangular body. In a preferred embodiment, the height of the rectangular body is between 0.5 meter (m) and 4 m, preferably between 1.0 m and 3.5 m, preferably between 1.5 m and 3.0 m. In a preferred embodiment, the width of the rectangular body is between 0.1 m and 2.5 m, preferably between 0.2 m and 2 m, preferably between 0.3 m and 2.0 m. In a preferred embodiment, the thickness of the rectangular body is between 1 millimeter (mm) and 50 mm, preferably between 2 mm and 30 mm, preferably between 3 mm and 20 mm.

In a preferred embodiment the first gangway end is arranged at an end of the first side panel that extends into the height direction.

In a preferred embodiment the second side panel has a height, the height being understood as the maximum extend of the second side panel into the height direction. In a preferred embodiment, the second side panel has a width, the width being understood as the maximum extend of the second side panel into a width direction, the width direction being perpendicular to the height direction. In a preferred embodiment, the second side panel has a thickness, the thickness being understood as the maximum extend of the second side panel into a thickness direction, the thickness direction being perpendicular to the height direction and perpendicular to the width direction.

In a preferred embodiment the height of the second side panel is larger than the width of the second side panel, preferably by a factor of more than 1.2, more preferably by a factor of more than 1.5, more preferably by a factor of more than 2. In a preferred embodiment the width of the second side panel is larger than the thickness of the second side panel, preferably by a factor of more than 2, more preferably by a factor of more than 5, more preferably by a factor of more than 10. In a preferred embodiment the height of the second side panel is larger than the width of the second side panel, whereby the width is larger than the thickness of the second side panel.

In a preferred embodiment the second side panel is a rectangular body. In a preferred embodiment, the height of the rectangular body is between 0.5 m and 4 m, preferably between 1.0 m and 3.5 m, preferably between 1.5 m and 3.0 m. In a preferred embodiment, the width of the rectangular body is between 0.1 m and 2.5 m, preferably between 0.2 m and 2 m, preferably between 0.3 m and 2.0 m. In a preferred embodiment, the thickness of the rectangular body is between 1 mm and 50 mm, preferably between 2 mm and 30 mm, preferably between 3 mm and 20 mm.

In a preferred embodiment the second gangway end is arranged at an end of the second side panel that extends into the height direction.

In a preferred embodiment, the first side panel and the second side panel have the same shape and/or size. In a preferred embodiment, the first side panel and the second side panel are designed mirror-symmetrical about a plane that is perpendicular to the sidewall and contains the height direction of the sidewall.

In a preferred embodiment a central main panel is provided. In a preferred embodiment, the central main panel is provided between the first side panel and the second side panel. In a preferred embodiment, the sidewall only contains the first side panel, the second side panel and the central main panel but no further panel of the size of the first side panel.

In a preferred embodiment, the central main panel has a height, the height being understood as the maximum extend of the central main panel into the height direction. In a preferred embodiment, the central main panel has a width, the width being understood as the maximum extend of the central main panel into a width direction, the width direction being perpendicular to the height direction. In a preferred embodiment, the central main panel has a thickness, the thickness being understood as the maximum extend of the central main panel into a thickness direction, the thickness direction being perpendicular to the height direction and perpendicular to the width direction.

In a preferred embodiment the height of the central main panel is larger than the width of the central main panel, preferably by a factor of more than 1.2, more preferably by a factor of more than 1.5, more preferably by a factor of more than 2. In a preferred embodiment the width of the central main panel is larger than the thickness of the central main panel, preferably by a factor of more than 2, more preferably by a factor of more than 5, more preferably by a factor of more than 10. In a preferred embodiment the height of the central main panel is larger than the width of the central main panel, whereby the width is larger than the thickness of the central main panel.

In a preferred embodiment the central main panel is a rectangular body. In a preferred embodiment, the height of the rectangular body is between 0.5 m and 4 m, preferably between 1.0 m and 3.5 m, preferably between 1.5 m and 3.0 m. In a preferred embodiment, the width of the rectangular body is between 0.1 m and 2.5 m, preferably between 0.2 m and 2 m, preferably between 0.3 m and 2.0 m. In a preferred embodiment, the thickness of the rectangular body is between 1 mm and 50 mm, preferably between 2 mm and 30 mm, preferably between 3 mm and 20 mm.

In a preferred embodiment the first side panel and the second side panel are made from the same material. In a preferred embodiment the first side panel and the second side panel and the central main panel are made from the same material. In a preferred embodiment the first side panel and the second side panel are made from the same material, but the central main panel is made from a different material.

In a preferred embodiment, the first side panel and/or the second side panel are made from aluminum.

In a preferred embodiment, the central main panel is made from glass reinforced plastic, preferably a sandwich material containing several layers, at least one of the layers being of glass reinforced plastic In a preferred embodiment the bending stiffness K of the central main panel against forces applied perpendicular to the front side of the central main panel, whereby the bending stiffness (K) is understood to be the ratio of applied force p (in N) to deflection w (in m) caused by the application of the force, is smaller (the value of K is larger) than the bending stiffness K of the first side panel against forces applied perpendicular to the front side of the first side panel.

and/or is smaller (the value of K is larger) than the bending stiffness K of the second side panel against forces applied perpendicular to the front side of the second side panel.

In a preferred embodiment the bending stiffness of the central main panel about at least one axis is lower by about 20 to 40 percent when compared to the bending stiffness of the first side panel about the same axis or an axis that is parallel to the axis. This is to say, the ratio of (bending stiffness of the central main panel about at least one axis)/(bending stiffness of the first side panel about the same axis or an axis that is parallel to the axis)=0.6 to 0.8. Hence, the central main panel preferably is more elastic than the first side panel. The at least one axis preferably is a vertical or a horizontal axis.

In a preferred embodiment the bending stiffness of the central main panel about a first axis is lower by about 20 to 40 percent when compared to the bending stiffness of the first side panel about the same first axis or an axis that is parallel to the first axis and the bending stiffness of the central main panel about a second axis that is perpendicular to the first axis is lower by about 20 to 40 percent when compared to the bending stiffness of the first side panel about the same second axis or an axis that is parallel to the second axis. This is to say, the ratio of (bending stiffness of the central main panel about the first axis)/(bending stiffness of the first side panel about the same first axis or an axis that is parallel to the first axis)=0.6 to 0.8 and the ratio of (bending stiffness of the central main panel about the second axis)/(bending stiffness of the first side panel about the same second axis or an axis that is parallel to the second axis)=0.6 to 0.8. The first axis preferably is a vertical and the second axis preferably is a horizontal axis.

In a preferred embodiment, the first side panel and/or the second side panel is made of a material that has and/or designed such that it has a Density of 2.70 kg/m3 plus or minus 10%, preferably a Density of 2.70 kg/m3 plus or minus 5%, even more preferred a Density of 2.70 kg/m3 plus or minus 2%.

In a preferred embodiment, the first side panel and/or the second side panel is made of a material that has and/or designed such that it has a Melting Point of 605° C. plus or minus 10%, preferably a Melting Point of 605° C. plus or minus 5%, even more preferred a Melting Point of 605° C. plus or minus 2%.

In a preferred embodiment, the first side panel and/or the second side panel is made of a material that has and/or designed such that it has a Modulus of Elasticity of 70 GPa plus or minus 10%, preferably a Modulus of Elasticity of 70 GPa plus or minus 5%, preferably a Modulus of Elasticity of 70 GPa plus or minus 2%.

In a preferred embodiment, the first side panel and/or the second side panel is made of a material that has and/or designed such that it has a Modulus of Electrical Resistivity of 0.34×10-6 Ω·m plus or minus 10%, preferably a Modulus of Electrical Resistivity of 0.34×10-6 Ω·m plus or minus 5%, preferably a Modulus of Electrical Resistivity of 0.34×10-6 Ω·m plus or minus 2%.

In a preferred embodiment, the first side panel and/or the second side panel is made of a material that has and/or designed such that it has a Thermal Conductivity of 188 W/m·K plus or minus 10%, preferably a Thermal Conductivity of 188 W/m·K plus or minus 5%, preferably a Thermal Conductivity of 188 W/m·K plus or minus 2%

In a preferred embodiment, the first side panel and/or the second side panel is made of a material that has and/or designed such that it has a Thermal Expansion of 24×10-6/K plus or minus 10%, a Thermal Expansion of 24×10-6/K plus or minus 5%, preferably a Thermal Expansion of 24×10-6/K plus or minus 2%.

In a preferred embodiment, the first side panel and/or the second side panel is made of a material that has and/or designed such that it has a Tensile Strength of 417.6 MPa plus or minus 10%, preferably a Tensile Strength of 417.6 MPa plus or minus 5%, preferably a Tensile Strength of 417.6 MPa plus or minus 2%.

In a preferred embodiment, the first side panel and/or the second side panel is made of a material that has and/or designed such that it has a Tensile Modulus of 23.0 GPa plus or minus 10%, preferably a Tensile Modulus of 23.0 GPa plus or minus 5%, preferably a Tensile Modulus of 23.0 GPa plus or minus 2%.

In a preferred embodiment, the first side panel and/or the second side panel is made of a material that has and/or designed such that it has a Poisson's Ratio of 0.12 plus or minus 10%, preferably a Poisson's Ratio of 0.12 plus or minus 5%, preferably a Poisson's Ratio of 0.12 plus or minus 2%.

In a preferred embodiment, the first side panel and/or the second side panel is made of a material that has and/or designed such that it has a Flexural Strength of 555.1 MPa plus or minus 10%, preferably a Flexural Strength of 555.1 MPa plus or minus 5%, preferably a Flexural Strength of 555.1 MPa plus or minus 2%.

In a preferred embodiment, the first side panel and/or the second side panel is made of a material that has and/or designed such that it has a Flexural Modulus of 20.9 GPa plus or minus 10%, preferably a Flexural Modulus of 20.9 GPa plus or minus 5%, preferably of a Flexural Modulus of 20.9 GPa plus or minus 2%.

In a preferred embodiment, the first side panel and/or the second side panel is made of a material that has and/or designed such that it has an Interlaminar Shear Strength of 40.7 MPa plus or minus 10%, preferably an Interlaminar Shear Strength of 40.7 MPa plus or minus 5%, preferably an Interlaminar Shear Strength of 40.7 MPa plus or minus 2%.

In a preferred embodiment, the first side panel and/or the second side panel is made of a material that has and/or designed such that it has an In-Plane Shear Strength of 78.5 MPa plus or minus 10%, preferably an In-Plane Shear Strength of 78.5 MPa plus or minus 5%, preferably an In-Plane Shear Strength of 78.5 MPa plus or minus 2%.

In a preferred embodiment, the first side panel and/or the second side panel is made of a material that has and/or designed such that it has an In-Plane Shear Modulus of 2.95 GPa plus or minus 10%, preferably an In-Plane Shear Modulus of 2.95 GPa plus or minus 5%, preferably an In-Plane Shear Modulus of 2.95 GPa plus or minus 2%.

In a preferred embodiment, the first side panel and/or the second side panel is made of a material that has and/or designed such that it has a Compressive Strength of 564 MPa plus or minus 10%, preferably a Compressive Strength of 564 MPa plus or minus 5%, preferably a Compressive Strength of 564 MPa plus or minus 2%.

In a preferred embodiment, the first side panel and/or the second side panel is made of a material that has and/or designed such that it has a Compressive Modulus of 24.3 GPa plus or minus 10%, preferably a Compressive Modulus of 24.3 GPa plus or minus 5%, preferably a Compressive Modulus of 24.3 GPa plus or minus 2%.

According to an aspect of the invention, the first side panel arranged to partially extend from a first side of the central main panel. In a preferred embodiment, the first side panel partially extends from the first side of the central main panel into the width direction of the first side panel, which preferably is also the width direction of the central main panel.

In a preferred embodiment the sidewall has a normal arrangement, which preferably is the arrangement that the parts of the sidewall will take up when the gangway is in a straight-line arrangement on a level terrain. In a preferred embodiment, there is an arrangement of the sidewall, which preferably is the normal arrangement of the sidewall, in which the amount (the distance) that the first side panel extends from the first side of the central main panel into the width direction of the first side panel is between 20% to 80%, preferably 30% to 70%, preferably 40% to 60%, preferably 45% to 55% of the width the first side panel.

According to an aspect of the invention, the second side panel arranged to partially extend from a second side of the central main panel. In a preferred embodiment, the second side panel partially extends from the second side of the central main panel into the width direction of the second panel, which preferably is also the width direction of the central main panel.

In a preferred embodiment, there is an arrangement of the sidewall, which preferably is the normal arrangement of the sidewall, in which the amount (the distance) that the second side panel extends from the second side of the central main panel into the width direction of the second side panel is between 20% to 80%, preferably 30% to 70%, preferably 40% to 60%, preferably 45% to 55% of the width the second side panel.

In a preferred embodiment the width of central main panel is larger than width of the first side panel. In a preferred embodiment the width of central main panel is larger than width of the first side panel by a factor of between 1.05 to 3, preferably by a factor of 1.2 to 2.5, preferably by a factor of 1.45 to 2.5.

In a preferred embodiment the width of central main panel is larger than width of the second side panel. In a preferred embodiment the width of central main panel is larger than width of the second side panel by a factor of between 1.05 to 3, preferably by a factor of 1.2 to 2.5, preferably by a factor of 1.45 to 2.5.

In a preferred embodiment, there is an arrangement of the sidewall, which preferably is the normal arrangement of the sidewall, in which the amount (the length) of that part of the first side panel that is arranged facing the back side of the central main panel is between 20% to 80%, preferably 30% to 70%, preferably 40% to 60%, preferably 45% to 55% of the width the first side panel. In a preferred embodiment, there is an arrangement of the sidewall, which preferably is the normal arrangement of the sidewall, in which the amount (the length) of that part of the first side panel that is arranged facing the back side of the central main panel is between 10% to 50%, preferably 15% to 45%, preferably 20% to 40%, preferably 25% to 35% of the width the central main panel.

In a preferred embodiment, there is an arrangement of the sidewall, which preferably is the normal arrangement of the sidewall, in which the amount (the length) of that part of the second side panel that is arranged facing the back side of the central main panel is between 20% to 80%, preferably 30% to 70%, preferably 40% to 60%, preferably 45% to 55% of the width the second side panel. In a preferred embodiment, there is an arrangement of the sidewall, which preferably is the normal arrangement of the sidewall, in which the amount (the length) of that part of the second side panel that is arranged facing the back side of the central main panel is between 10% to 50%, preferably 15% to 45%, preferably 20% to 40%, preferably 25% to 35% of the width the central main panel.

In a preferred embodiment, the front side of the central main panel and/or the front side of the first side panel and/or the front side of the second side panel is a flat surface.

In a preferred embodiment, the back side of the central main panel and/or the back side of the first side panel and/or the back side of the second side panel is a flat surface. In a preferred embodiment the back side of the central main panel is a flat surface but has a central rim arranged on the back side of the central main panel, said central rim extending parallel to the first side and/or parallel to the second side of the central main panel. The central rim can be used as an abutment against which the first side panel or the second side panel can abut in certain driving conditions.

In a preferred embodiment, the sidewall as regards the number of panels arranged parallel to one another consists of the central main panel, the first side panel and the second side panel.

According to an aspect of the invention at least one connection rod is provided, whereby

- a first connection is provided that connects the connection rod to the back of the first side panel,
- a second connection is provided that connects the connection rod to the back of the central main panel,
- a third connection is provided that connects the connection rod to the back of the second side panel.

In a preferred embodiment an upper connection rod is provided, whereby

- a first connection is provided that connects the upper connection rod to the back of the first side panel,
- a second connection is provided that connects the upper connection rod to the back of the central main panel,
- a third connection is provided that connects the upper connection rod to the back of the second side panel and a lower connection rod is provided, whereby
- a first connection is provided that connects the lower connection rod to the back of the first side panel,
- a second connection is provided that connects the lower connection rod to the back of the central main panel,
- a third connection is provided that connects the lower connection rod to the back of the second side panel, the upper connection rod being arranged above the lower connection rod. In a preferred embodiment the upper connection rod is arranged in an upper part of the sidewall. In a preferred embodiment, the upper connection rod is arranged closer to the middle of the sidewall than a top end of the sidewall. Preferably the upper connection rod is arranged in a part of the sidewall that extends from middle of the sidewall towards a top end of the sidewall by an amount (by a length) that is in between 0.5% to 45% of the height of the sidewall, preferably in between 1% to 40%, preferably 2% to 35%, preferably 5% to 35% of the height of the sidewall. In a preferred embodiment, the lower connection rod is arranged closer to the middle of the sidewall than a bottom end of the sidewall. Preferably the lower connection rod is arranged in a part of the sidewall that extends from middle of the sidewall towards a bottom end of the sidewall by an amount (by a length) that is in between 0.5% to 45% of the height of the sidewall, preferably in between 1% to 40%, preferably 2% to 35%, preferably 5% to 35% of the height of the sidewall. In a preferred embodiment, the upper connection rod and the lower connection rod are arranged mirror-symmetrically about a plane that extends perpendicular to the height direction and is arranged in the middle of the height of the sidewall.

In a preferred embodiment the first connection contains a joint that allows the rod to rotate relative to the back of the first side panel. The joint can be provided by a pin that is attached to one element, for example to the connection rod, which pin is held in a hole provided by the second element, for example provided by a block arranged on the second element, for example by a block arranged on the back side of the first side panel, the pin being allowed to rotate inside the hole. The joint could also be provided by more complex design, for example by way of a ball joint.

In a preferred embodiment the second connection contains a joint that allows the rod to rotate relative to the back side of the central main panel. The joint can be provided by a pin that is attached to one element, for example to the connection rod, which pin is held in a hole provided by the second element, for example provided by a block arranged on the second element, for example by a block arranged on the back side of the central main panel, the pin being allowed to rotate inside the hole. The joint could also be provided by more complex design, for example by way of a ball joint.

In a preferred embodiment the third connection contains a joint that allows the rod to rotate relative to the back side of the second side panel. The joint can be provided by a pin that is attached to one element, for example to the connection rod, which pin is held in a hole provided by the second element, for example provided by a block arranged on the second element, for example by a block arranged on the back side of the second side panel, the pin being allowed to rotate inside the hole. The joint could also be provided by more complex design, for example by way of a ball joint.

In a preferred embodiment the rotation axis about which the connection rod rotates relative to the back side of the respective panel is a rotation axis that is perpendicular to the back side of the panel.

In a preferred embodiment, a pre-tension means, for example a spring, for example a coil spring connects the first connection to the second connection. In a preferred embodiment, a pre-tension means, for example a spring, for example a coil spring connects the second connection to the third connection. In a preferred embodiment, a pre-tension means, for example a spring, for example a coil spring connects the first connection to the third connection.

In a preferred embodiment, the first connection contains a linear guide that allows the rod to move in a linear direction within the first connection. In a preferred embodiment, the linear guide is combined with a joint that allows the rod to rotate relative to the back of the first side panel. The linear guide can be provided by a bush, whereby the connection rod passes through a bush and whereby the bush is connected to the back side of the first panel by way of the joint. The linear guide also can be a slit in the connection rod with a pin that also forms part of the joint being slideably arranged in the slit. In a preferred embodiment the linear direction is parallel to the width direction of the sidewall when the sidewall is in the normal arrangement.

In a preferred embodiment, the second connection contains a linear guide that allows the rod to move in a linear direction within the second connection. In a preferred embodiment, the linear guide is combined with a joint that allows the rod to rotate relative to the back of the central main panel. The linear guide can be provided by a bush, whereby the connection rod passes through a bush and whereby the bush is connected to the back side of the central main panel by way of the joint. The linear guide also can be a slit in the connection rod with a pin that also forms part of the joint being slideably arranged in the slit. In a preferred embodiment the linear direction is parallel to the width direction of the sidewall when the sidewall is in the normal arrangement.

In a preferred embodiment, the third connection contains a linear guide that allows the rod to move in a linear direction within the third connection. In a preferred embodiment, the linear guide is combined with a joint that allows the rod to rotate relative to the back of the second side panel. The linear guide can be provided by a bush, whereby the connection rod passes through a bush and whereby the bush is connected to the back side of the second panel by way of the joint. The linear guide also can be a slit in the connection rod with a pin that also forms part of the joint being slideably arranged in the slit. In a preferred embodiment the linear direction is parallel to the width direction of the sidewall when the sidewall is in the normal arrangement.

In a preferred embodiment, the first connection contains a linear guide that allows the rod to move in a linear direction within the first connection, the second connection contains a linear guide that allows the rod to move in a linear direction within the second connection, but the third connection only contains a joint and connects the connection rod to the central main panel without allowing linear movement of the connection rod relative to the central main panel.

In a preferred embodiment, the back side of the central main panel contacts the front side of the first side panel. In a preferred embodiment, the back side of the central main panel can slide relative to the front side of the first side panel. In a preferred embodiment, the back side of the central main panel can be lifted from the front side of the first side panel.

In a preferred embodiment, the back side of the central main panel contacts the front side of the second side panel. In a preferred embodiment, the back side of the central main panel can slide relative to the front side of the second side panel. In a preferred embodiment, the back side of the central main panel can be lifted from the front side of the second side panel.

In a preferred embodiment, the rod has at least one telescopic section. In a preferred embodiment the rod has a center rod that has a first end that is arranged within a first end tube thereby forming a telescopic section. In a preferred embodiment, the first end tube is connected to back of the first side panel by way of the first connection. In a preferred embodiment the rod has a center rod that has a second end that is arranged within a second end tube thereby forming a telescopic section. In a preferred embodiment, the second end tube is connected to back of the second side panel by way of the third connection. In a preferred embodiment the center rod is connected to the back side of the central main panel by way of the second connection.

In a preferred embodiment a first vehicle mounting plate is provided at one side of the first side panel and a second vehicle mounting plate is provided at one side of the second side panel, whereby a telescopic rod is provided that connects the first vehicle mounting plate to the second vehicle mounting plate. In a preferred embodiment an upper telescopic rod is provided that connects the first vehicle mounting plate to the second vehicle mounting plate in an upper part of the sidewall and a lower telescopic rod is provided that connects the first vehicle mounting plate to the second vehicle mounting plate in a lower part of the sidewall. In a preferred embodiment the upper telescopic rod is arranged closer to a top end of the sidewall than an upper connection rod. In a preferred embodiment the lower telescopic rod is arranged closer to a bottom end of the sidewall than a lower connection rod.

In a preferred embodiment the telescopic rod has a first end that is connected to the first vehicle mounting plate by way of a joint, preferably a cardan joint. In a preferred embodiment the telescopic rod has a second end that is connected to the second vehicle mounting plate by way of a joint, preferably a cardan joint.

In a preferred embodiment, the sidewall according to the invention has a first vehicle mounting plate. The first vehicle mounting plate is the item of the gangway that is intended for attaching the gangway to an end of a vehicle with the first vehicle mounting plate. The first vehicle mounting plate hence preferably has means for connecting the gangway to the end of the vehicle, for example hooks or for example holes for placing bolts there through. The first vehicle mounting plate for example looks like the items indicated with the reference sign 10 in FIGS. 2, 3, 4 and 5 of EP 2 565 098 A1. In a preferred embodiment, the first vehicle mounting plate is part of a frame, especially preferred a ring-shaped frame, for example a square ring of four longitudinal bars attached to each other at angles of 90°. The first vehicle mounting plate can also be part of an inverted u-shaped frame, the legs of the u being the first vehicle mounting plates of facing sidewalls of the gangway respectively and the connecting bar of the u being located close to the ceiling or forming part of the ceiling.

In a preferred embodiment the sidewall according to the invention has a second vehicle mounting plate. The second vehicle mounting plate is the item of the gangway that is intended for attaching the gangway to an end of a vehicle with the second vehicle mounting plate. The second vehicle mounting plate hence preferably has means for connecting the gangway to the end of the vehicle, for example hooks or for example holes for placing bolts there through. The second vehicle mounting plate for example looks like the items indicated with the reference sign 10 in FIGS. 2, 3, 4 and 5 of EP 2 565 098 A1. In a preferred embodiment, the second vehicle mounting plate is part of a frame, especially preferred a ring-shaped frame, for example a square ring of four longitudinal bars attached to each other at angles of 90°. The second vehicle mounting plate can also be part of an inverted u-shaped frame, the legs of the u being the second vehicle mounting plates of facing sidewalls of the gangway respectively and the connecting bar of the u being located close to the ceiling or forming part of the ceiling.

The gangway according to an aspect of the invention has a sidewall according to the invention.

In a preferred embodiment, the gangway has two facing sidewalls, preferably two sidewalls according to the invention that face each other. A gangway according to the invention has a floor and a ceiling. The room between the two facing sidewalls, the floor and the ceiling is considered as the space that passengers can walk through. The sidewalls can be of any design known from the prior art.

The gangway might also have bellows arranged to the outside of the sidewalls and the ceiling and possibly also parts of the floor.

The floor can also be one solid plate attached to the vehicle mounting plates. However, in a more preferred embodiment, the floor is made up of several plates, whereby the one plate rests with one end on a neighboring plate. The floor can, for example, have a first tread plate that is attached to the first vehicle mounting plate, and a center floor plate that rests with one end on the first tread plate, and a further, second tread plate that is attached to the second vehicle mounting plate, whereby the center floor plate also rests with one end on the second tread plate. Other designs with more plates resting upon each other or being connected to one each other in a flexible manner are also feasible.

The ceiling can also be one solid plate attached to the vehicle mounting plates. However, in a more preferred embodiment, the ceiling is made up of several plates, whereby the one plate rests with one end on a neighboring plate. The ceiling can, for example, have a first plate that is attached to the first vehicle mounting plate, and a center ceiling plate that rests with one end on the first plate, and a further, second plate that is attached to the second vehicle mounting plate, whereby the center ceiling plate also rests with one end on the second plate. Other designs with more plates resting upon each other or being connected to one each other in a flexible manner are also feasible.

In a preferred embodiment, the gangway has a normal position, in which a floor of the gangway takes up a predetermined position and the sidewall takes up a predetermined position, whereby the sidewall has a bottom edge and whereby in the normal position the bottom edge is arranged at a predetermined position relative to the floor, whereby in that normal position a gap exists between the bottom edge and the floor.

In a preferred embodiment in the normal position a central plate of a floor or a ceiling respectively is orientated horizontally.

The multi-car vehicle according to the invention has a first car and a second car, whereby the first car has an end and whereby the second car has an end, whereby a gangway according to the invention is arranged between the first car and the second car. Preferably the first vehicle mounting plate is attached to the end of the first car and the second vehicle mounting plate is attached to the second car.

BRIEF DESCRIPTION OF THE DRAWINGS

In the following the invention will be described with reference to Figures that show exemplary embodiments of the invention.

DETAILED DESCRIPTION

Figure 1:
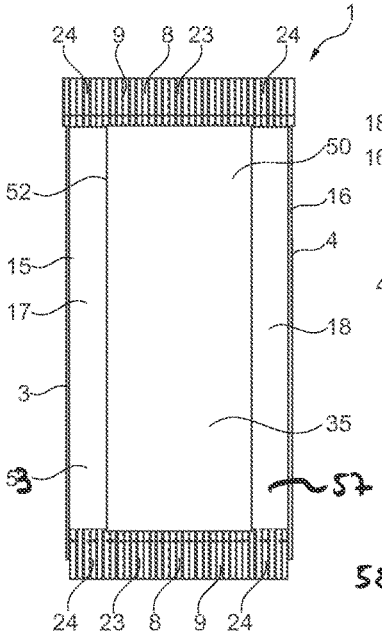
FIG. 1 shows a schematic view onto the front of a sidewall according an embodiment of to the invention.
Figure 2:
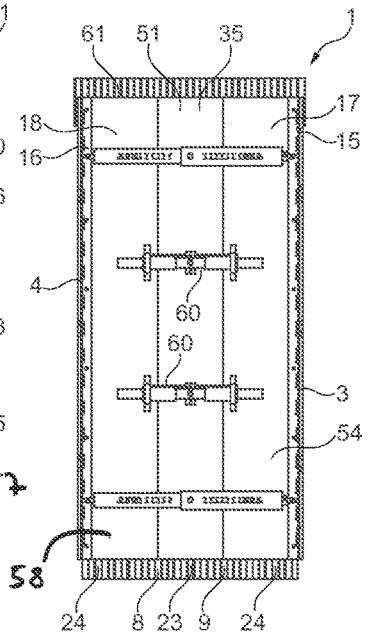
FIG. 2 shows a schematic view onto the back of a sidewall according to FIG. 1.
Figure 3:
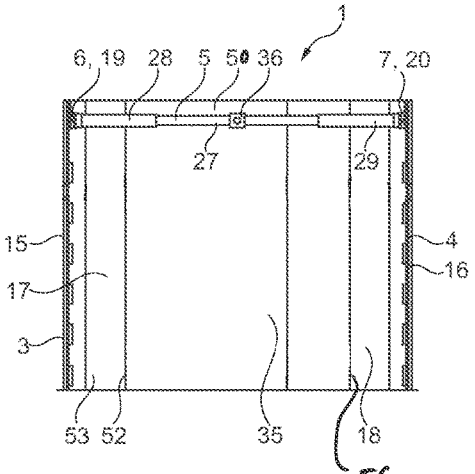
FIG. 3 shows a schematic view onto the top part of the front of a sidewall according to FIG. 1 with the cover pieces that make up the cover having been removed to show the design of the rod.

FIG. 1 shows a part of a sidewall 1 and the floor 2 of a gangway, which gangway has two facing sidewalls, a floor 2 and a ceiling (not shown). The gangway has a first vehicle mounting plate 3 arranged at a first gangway end 15, the first vehicle mounting plate 3 being suitable to attach the gangway to an end of a vehicle and a second vehicle mounting plate 4 arranged at a second gangway end 16, said second gangway end 16 being opposite the first gangway end 15, the second vehicle mounting plate 4 being suitable to attach the gangway to an end of a vehicle.

In FIG. 1 the first vehicle mounting plate 3 and the second vehicle mounting plate 4 each are shown as a vertical bar. The respective vertical bar can be a stand-alone bar with further, separate bars possibly being arranged at the first gangway end and/or the second gang way end respectively in the region of the ceiling and/or the region of the facing sidewall. In an alternative embodiment, the respective vertical bar shown in FIG. 1 can be part of a frame shaped structure, for example a u-shaped structure or a rectangular frame, which serve as interface between the gangway and the respective end of the vehicle.

The sidewall 1 comprises a central main panel (35) having a front side 50 and a back side 51. A first side panel 17 is arranged to partially extend from a first side 52 of the central main panel 35, the first side panel 17 having a front side 53 and a back side 54, a part 55 of the front side 53 of the first side panel 17 being arranged facing the back side 51 of the central main panel 35. A second side panel 18 is arranged to partially extend from a second side 56 of the central main panel 35, opposite to the first side 52 of the central main panel 35, the second side panel 18 having a front side 57 and a back side 58, a part 59 of the front side 57 of the second side panel 18 being arranged facing the back side 51 of the central main panel 35.

Two connection rods 60 are provided, one arranged above the other in the direction of the height of the sidewall. The respective upper connection rod 60 being arranged closer to the middle of the sidewall 1 in the height direction than towards a top end 61 of the sidewall 1. The respective lower connection rod 60 being arranged closer to the middle of the sidewall 1 in the height direction than towards a bottom end 62 of the sidewall 1.

A first connection 63 is provided that connects the connection rod 60 to the back side 54 of the first side panel 17. The first connection 63 comprises a linear guide 64 provided by a bush 65 and a joint 66, the joint being provided by a pin 67 attached to the bush 65, an end 68 of the pin 67 being arranged in a hole of a block 69. The block 69 is attached to the back side 54 of the first side panel 17. The pin 67 is allowed to rotate inside the block 69, thereby allowing the connection rod 60 to rotate relative to the back side 54 of the first side panel 17.

A second connection 73 is provided that connects the connection rod 60 to the back side 51 of the central main panel 35. The second connection 73 comprises a joint 76, the joint 76 being provided by a pin 77 attached to a central rod 70, an end 78 of the pin 77 being arranged in a hole of a block 79. The block 79 is attached to the back side 51 of the central main panel 35. The pin 77 is allowed to rotate inside the block 79, thereby allowing the connection rod 60 to rotate relative to the back side 51 of the central main panel 35.

A third connection 83 is provided that connects the connection rod 60 to the back side 58 of the second side panel 18. The third connection 83 comprises a linear guide 84 provided by a bush 85 and a joint 86, the joint being provided by a pin 87 attached to the bush 85, an end 88 of the pin 87 being arranged in a hole of a block 89. The block 89 is attached to the back side 58 of the second side panel 18. The pin 87 is allowed to rotate inside the block 89, thereby allowing the connection rod 60 to rotate relative to the back side 58 of the second side panel 18.

The central rod 70 is arranged to extend through the bush 65 and the bush 85. The bush 65 defines a linear direction that is parallel to the width direction of the sidewall 1. The bush 85 defines a linear direction that is parallel to the width direction of the sidewall 1.

A coil spring 71 is arranged between the block 69 and the block 79. A further coil spring 72 is arranged between the block 79 and the block 89.

The central main panel is made from a glass reinforced plastic.

The first side panel and the second side panel are made from aluminum, preferably aluminum 6005A.

Two telescopic rods 80 are provided. The first vehicle mounting plate 3 is provided at one side of the first side panel 17 and the second vehicle mounting plate 4 is provided at one side of the second side panel 18. Each of the two telescopic rods 80 connects the first vehicle mounting plate 3 to the second vehicle mounting plate 4. The upper telescopic rod 80 is arranged closer to the top end 61 than the upper connection rod 60. The lower telescopic rod 80 is arranged closer to the bottom end 62 than the lower connection rod 60.

The respective telescopic rod 80 is connected to the first vehicle mounting plate 3 by means of a cardan joint 81. The respective telescopic rod 80 is connected to the second vehicle mounting plate 4 by means of a cardan joint 82.

A coil spring 74 is arranged inside the telescopic rod 80 and pre-tensions the telescopic rod 80 and hence the first vehicle mounting plate 3 and the second vehicle mounting plate 4 into a predetermined position. If the ends of the telescopic rod 80 are moved closer together, which means that the first vehicle mounting plate 3 and the second vehicle mounting plate 4 at those points, where they are connected to the telescopic rod 80, come closer together, the coil spring 74 is compressed and attempts by way of expanding to move the ends of the telescopic rod 80 further apart (e.g. to return to a predetermined position). If the ends of the telescopic rod 80 are moved further apart, which means that the first vehicle mounting plate 3 and the second vehicle mounting plate 4 at those points, where they are connected to the telescopic rod 80, come further apart, the coil spring 74 is expanded and attempts by way of coming back together to move the ends of the telescopic rod 80 closer together (e.g. to return to a predetermined position).

Figure 4:
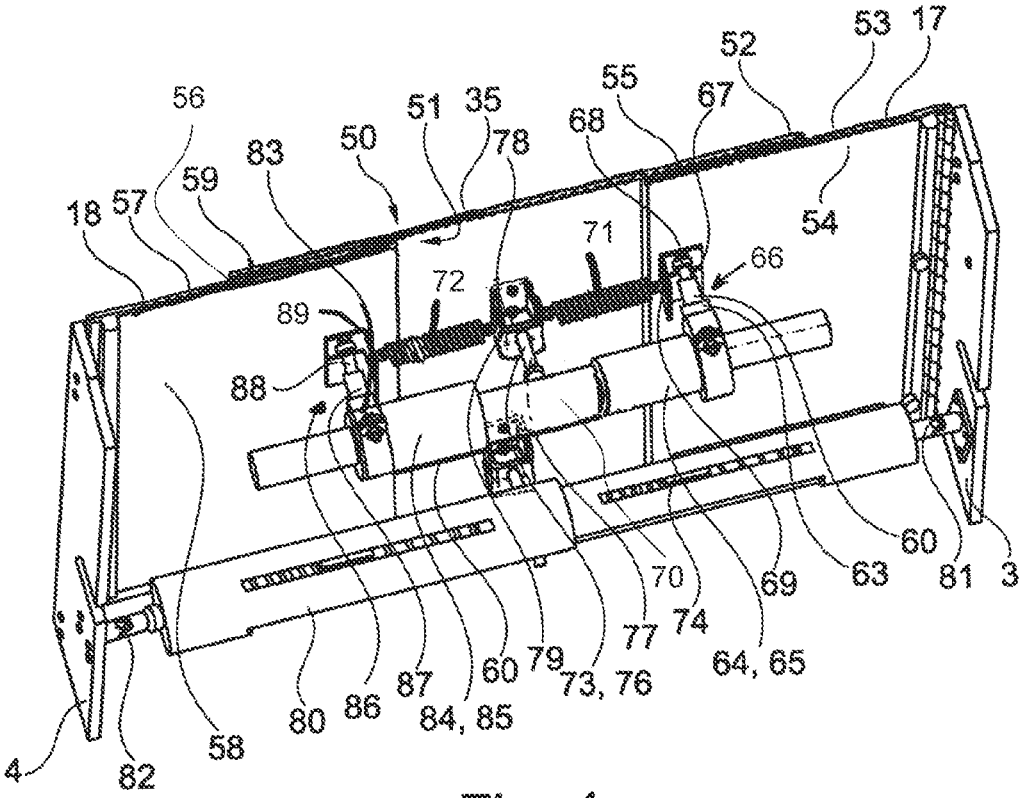
FIG. 4 shows a schematic, partially sectional perspective view onto the back of the sidewall according to FIG. 1.
Figure 5:
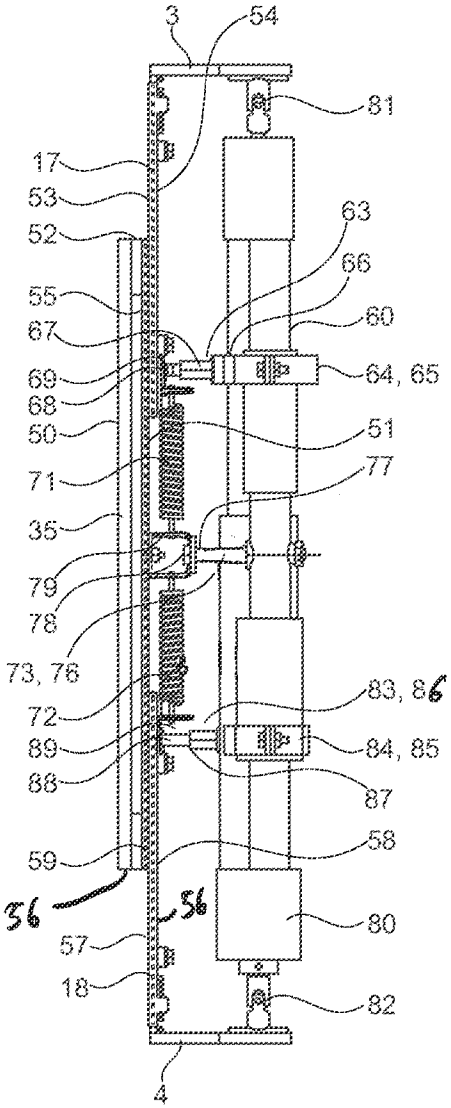
FIG. 5 shows a top view onto the sidewall according to FIG. 1 without a rod or a cover.

The slits in tubes 80 and 74 in FIG. 4 are for sliding purpose. In between the tubes 80 and 74 there will be another tube (Central tube) sliding in between. This central tube preferably does not rotate inside the tubes 80 and 74 as this might cause the central main panel to lift itself downwards during normal position since the central main panel is connected to this Center tube.

To avoid this, the center tube has an extrusion. This extrusion will be slide in the slits on tube 80 and 74. This will avoid the center tube to rotate independently.

The rotation of the central tube now turned as a dependent tube, dependent on the movement of the tube 80 and 74. The central tube now can be rotated by the tube 80 and 74.

The gangway has a retractable rail 5 that has a first rail end 6 that is connected to a first side panel 17 and that has a second rail end 7 opposite the first rail end 6, which second rail end 7 is connected to a second side panel 18. The retractable rail 5 extends along a longitudinal axis A.

As shown in FIGS. 1, 2, 10, 12 a cover 8 is provided. The cover 8 is attached to the rail 5 and extends along the rail 5. The cover 8 has a flexible portion 9 that extends from the rail 5 into a direction perpendicular to the longitudinal axis A.

As can be seen from FIGS. 3, 6, 7, 8, 9 the retractable rail 5 is a telescopic rod.

Figure 6:
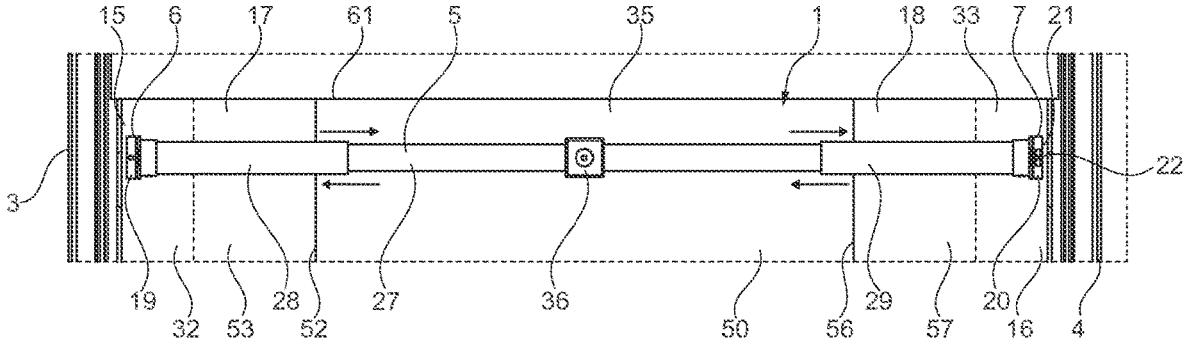
FIG. 6 shows a close-up schematic view onto the rod shown in FIG. 3.
Figure 7:
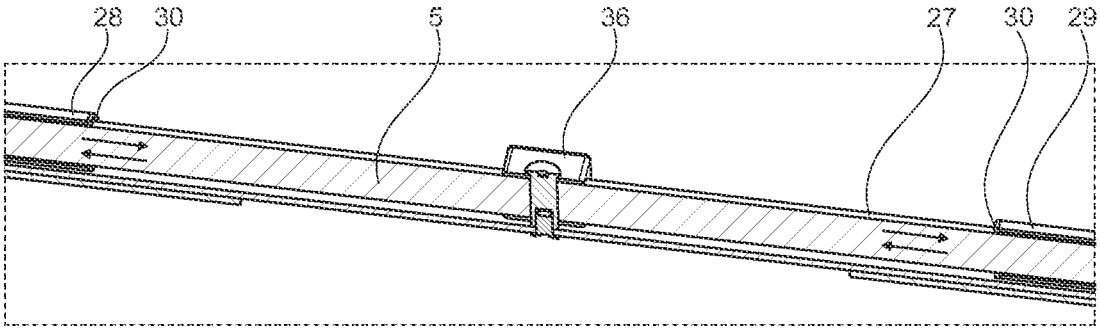
FIG. 7 shows a schematic sectional view of the rod according to FIG. 3.
Figure 8:
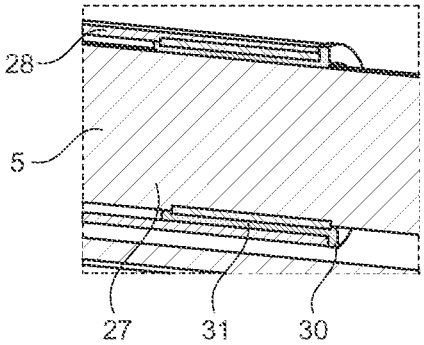
FIG. 8 shows a schematic sectional view of a detail of the rod of FIG. 7.
Figure 9:
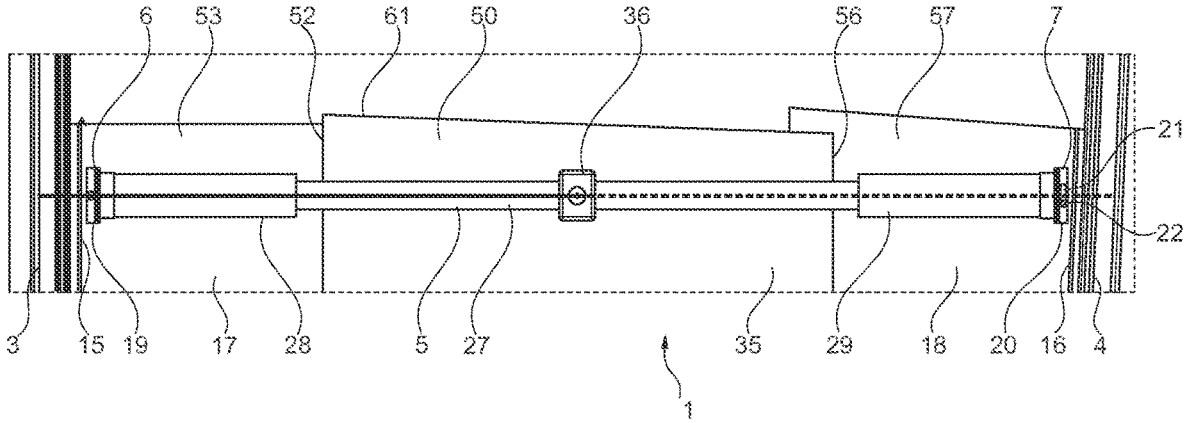
FIG. 9 shows the view of FIG. 6 with the panels of the sidewall arranged in a different condition.

As can be seen from FIGS. 6 and 9 the first rail end 6 is connected to the first side panel 17 by way of a joint 19 that allows swivel movement of the rail 5 relative to the first side panel 17 and the second rail end 7 is connected to the second side panel 18 by way of a joint 20 that allows swivel movement of the rail 5 relative to the second side panel 18. As can be seen, the joint 20 has a slot 21 and a pin 22 arranged in the slot 21. This arrangement allows a limited linear movement of the second rail end 7 relative to the second side panel 18 in the height direction (the direction upwards in FIG. 9), namely limited by the length of the slot 21.

The retractable rail 5 is an element that consists of two telescopic rods that have a joint center rod 27. One end of the center rod 27 is arranged within a first end tube 28 to create one telescopic rod, the opposite end of the center rod 27 is arranged within a second end tube 29 to create the second telescopic rod. The first end tube 28 is connected to the first gangway end 15 and the second end tube 29 is connected to the second gangway end 16. The first end tube 28 has an open end into which the one end of the center rod 27 is arranged. A nylon bush 30 is arranged at the open end, the nylon bush 30 being arranged around the center rod 27 and extending inwards into the first end tube 28 from the open end. A rubber bush 31 is arranged around the nylon bush 30, which rubber bush 31 extends inwards into the first end tube 28 from the open end and extends inwards into the first end tube 28 from the open end by the same or a lesser amount than the nylon bush 30. The retractable rail is designed mirror symmetrical about a plane that is arranged perpendicular to the longitudinal axis A as regards the design of a center rod 27 and the design of a first end tube 28 and a second end tube 29, but designed differently as regards the attachment of the first end tube 28 to the first gangway end 15 compared to the attachment of the second end tube 29 to the second gangway end 16.

The term "connected to the first gangway end" is understood to encompass the shown connection of the first rail end 6 to the first side panel 17 in an endzone 32 of the first side panel 17, the endzone 32 being smaller than a third of the width of the first side panel 17. The term "connected to the second gangway end" is understood to encompass the shown connection of the second rail end 7 to the second side panel 18 in an endzone 33 of the second side panel 18, the endzone 33 being smaller than a third of the width of the second side panel 18.

A central main panel 35 is provided between the first side panel 17 and the second side panel 18. The rail 5 is connected central main panel 35 by way of a joint 36.

The cover is made up of a series of individual cover pieces 23, 24. The cover pieces 23, 24 are block-shaped pieces. The cover pieces 23, 24 the same geometric shape and/or size. The cover pieces 23, 24 are connected to the rail 5 and extend from the rail 5 into a direction perpendicular to the longitudinal axis A. The cover pieces 23 are designed to be more flexible in that part that is further away from the rail 5 than that part of the respective cover piece that is attached to the rail 5. The difference in flexibility is achieved by differences in shape of the respective parts of the respective cover piece 23, namely by at least one hole 25 that by its rim and its cooperation with the rail 5 provides stiffness. The rail 5 passes through the hole 25.

In the series of individual cover pieces 23,24 at least a first sub-series of cover pieces 24 with a first elasticity and a further sub-series of cover pieces 23 with a second elasticity is provided. In a preferred embodiment within the series of individual cover pieces 23, 24

- a first sub-series of cover pieces 24 with a lower elasticity is provided closer to the first gangway end 15,
- a second sub-series of cover pieces 24 with the same elasticity than the elasticity of the cover pieces 24 of the first sub-series, is provided closer to the second gangway end 16,
- and a third sub-series of cover pieces 23 with a higher elasticity is provided, the cover pieces 23 of the third sub-series being arranged between the cover pieces 24 of the first sub-series and the cover pieces 24 of the second sub-series.

The difference in elasticity of the cover pieces 23 of the one sub-series relative to the cover pieces 24 of the other sub-series is achieved by having the cover-pieces 23 of the sub-series with the higher elasticity being at least partially hollow and the cover-pieces 24 of the sub-series with the lower elasticity being solid.

Figure 12:
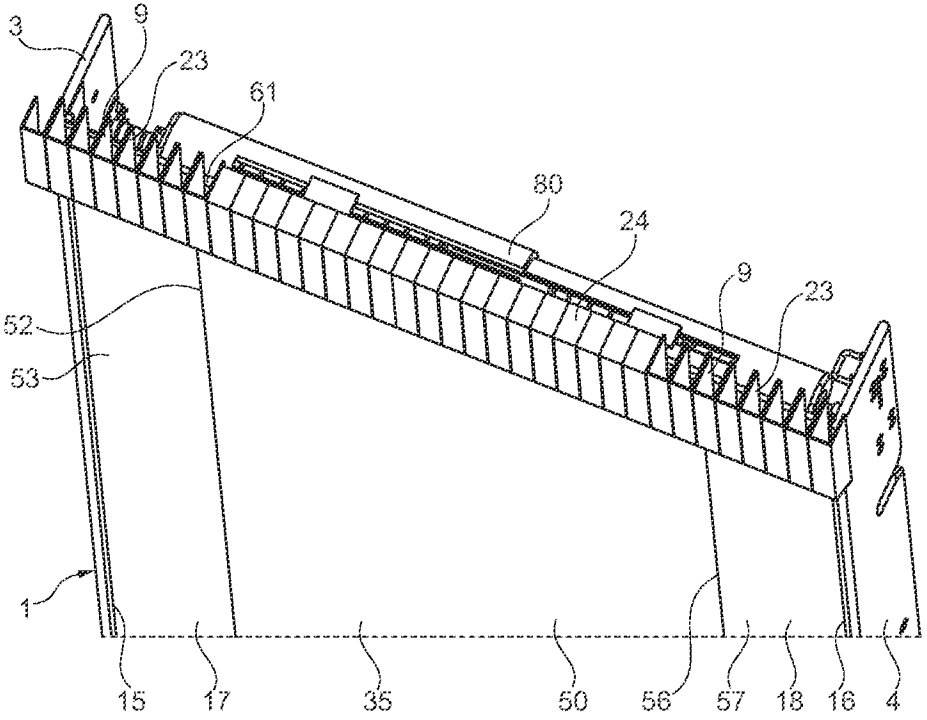
FIG. 12 shows a schematic perspective view onto the top of the sidewall.
Figure 13:
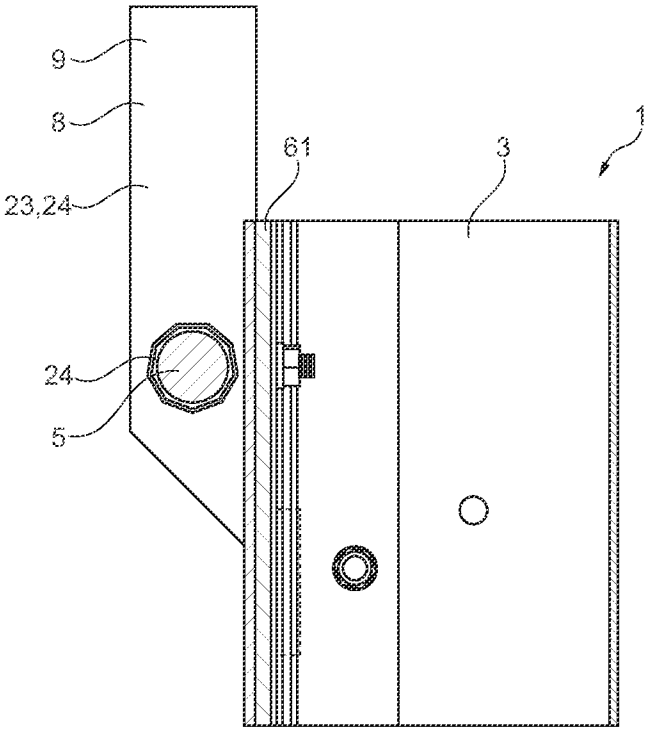
FIG. 13 shows a schematic sectional view through the top of the sidewall.

FIG. 12 shows an embodiment where an alternative is implemented, wherein the more flexible, hollow cover pieces 23 are arranged closer to the first gangway end 6 and the second gangway end 7 and the solid cover pieces 24 are arranged in the middle.

The cover pieces 23, 24 extend away from the rail into the direction perpendicular to the longitudinal axis by the same amount.

The flexible portion 9 contains a series of individual cover pieces 23, 24 that are arranged next to each other and that extend into a direction perpendicular to the longitudinal axis A.

Figure 10:
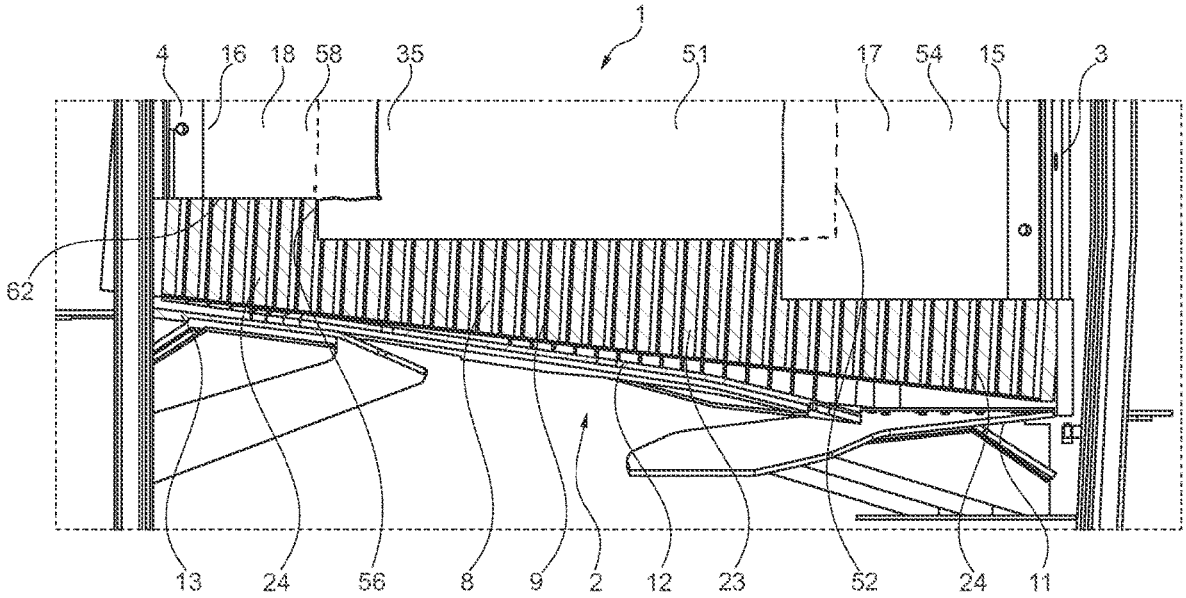
FIG. 10 shows a schematic side view onto a lower part of the sidewall and the floor of the gangway.
Figure 11:
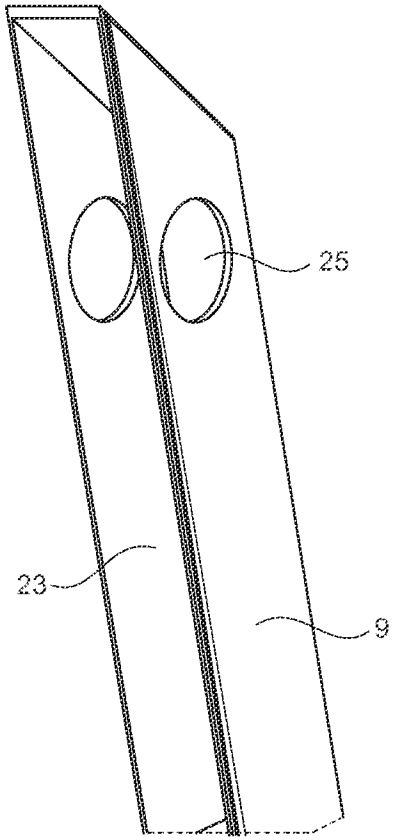
FIG. 11 shows a schematic perspective view onto a cover piece.

FIG. 10 shows a position of the gangway in a driving condition where the first vehicle mounting plate 3 is situated higher than the second vehicle mounting plate 4. As can be seen from FIG. 8, because the first rail end 6 is attached to the first side panel 17 and because the second rail end 7 is attached to the second side panel 18, the rail 5 and with the cover 8 takes up a slanted position.

FIG. 10 shows that in this particular embodiment of the gangway the floor 3 has a first tread plate 11 that is attached to the first vehicle mounting plate 3, a central plate 12 that is provided and a second tread plate 14 that is attached to the second vehicle mounting plate 4. The central plate 12 with one end rests on the end of the first tread plate 11 and with another end rests on the second tread plate 14.

As can be seen in FIG. 10 the driving condition that the gangway has taken up in FIG. 10 leads to the central plate 12 to take up a slanted position.

As can be seen in FIG. 10, because the cover 8 takes up a slanted position it has the ability to better cover a gap between the bottom end of the sidewall 1 and the parts of the floor 3.

It is understood that all presented embodiments are only exemplary, and that any feature presented for a particular example embodiment may be used with any aspect of the invention on its own or in combination with any feature presented for the same or another particular example embodiment and/or in combination with any other feature not mentioned. It will further be understood that any feature presented for an example embodiment in a particular category (method/apparatus/system) may also be used in a corresponding manner in an example embodiment of any other category. Those skilled in the art should appreciate that they may readily use the present disclosure as a basis for designing or modifying other processes and structures for carrying out the same purposes and/or achieving the same advantages of the embodiments introduced herein. Those in the art will recognize that other embodiments may be practiced with modifications and alterations limited only by the claims.

What is claimed is:

1. A sidewall for a gangway, the sidewall comprising:

- a central main panel having a front side and a back side;
- a first side panel arranged to partially extend from a first side of the central main panel, the first side panel having a front side and a back side, a part of the front side of the first side panel being arranged facing the back side of the central main panel;
- a second side panel arranged to partially extend from a second side of the central main panel, opposite to the first side of the central main panel, the second side panel having a front side and a back side, a part of the front side of the second side panel being arranged facing the back side of the central main panel;

and at least one connection rod, wherein a first connection is provided that connects the connection rod to the back side of the first side panel;

a second connection is provided that connects the connection rod to the back side of the central main panel;

a third connection is provided that connects the connection rod to the back side of the second side panel; and wherein a first vehicle mounting plate is provided at one side of the first side panel and a second vehicle mounting plate is provided at one side of the second side panel, and wherein a telescopic rod connects the first vehicle mounting plate to the second vehicle mounting plate.

2. The sidewall according to claim 1, wherein:

the central main panel is made from a first material; and at least one of the first side panel and the second side panel is made from a second material;

wherein the first material is more flexible than the second material.

3. The sidewall according to claim 2, wherein the first side panel and the second side panel are made from the second material.

4. The sidewall according to claim 1, wherein at least one of the front side of the central main panel, the front side of the first side panel, or the front side of the second side panel, is a rectangular plane surface.

5. The sidewall according to claim 4, wherein the front side of the central main panel is a rectangular plane surface; and the front side of the first side panel is a rectangular plane surface; and the front side of the second side panel is a rectangular plane surface.

6. The sidewall according to claim 1, further comprising a central rim arranged on the back side of the central main panel, said central rim extending parallel to at least one of the first side and to the second side of the central main panel.

7. The sidewall according to claim 6, wherein said central rim extends parallel to the first side and parallel to the second side of the central main panel.

8. The sidewall according to claim 1, wherein the first connection contains a joint that allows the connection rod to rotate relative to the back side of the first side panel;

the second connection contains a joint that allows the connection rod to rotate relative to the back side of the central main panel;

third connection contains a joint that allows the connection rod to rotate relative to the back side of the second side panel.

9. The sidewall according to claim 1, wherein the first connection contains a linear guide that allows the connection rod to move in a linear direction within the first connection;

the second connection contains a linear guide that allows the connection rod to move in a linear direction within the second connection;

the third connection contains a linear guide that allows the connection rod to move in a linear direction within the third connection.

10. The sidewall according to claim 1, wherein the connection rod has at least one telescopic section.

11. A gangway comprising:

a floor; and a sidewall, said sidewall comprising:

a central main panel having a front side and a back side;

a first side panel arranged to partially extend from a first side of the central main panel, the first side panel having a front side and a back side, a part of the front side of the first side panel being arranged facing the back side of the central main panel;

a second side panel arranged to partially extend from a second side of the central main panel, opposite to the first side of the central main panel, the second side panel having a front side and a back side, a part of the front side of the second side panel being arranged facing the back side of the central main panel; and at least one connection rod, wherein a first connection is provided that connects the connection rod to the back side of the first side panel;

a second connection is provided that connects the connection rod to the back side of the central main panel;

a third connection is provided that connects the connection rod to the back side of the second side panel;

wherein a first vehicle mounting plate is provided at one side of the first side panel and a second vehicle mounting plate is provided at one side of the second side panel, and wherein a telescopic rod connects the first vehicle mounting plate to the second vehicle mounting plate.

12. The gangway of claim 11, further comprising a first vehicle mounting plate arranged at a first gangway end, the first vehicle mounting plate configured to attach the gangway to an end of a vehicle, and a second vehicle mounting plate arranged at a second gangway end, said second gangway end being opposite the first gangway end, the second vehicle mounting plate configured to attach the gangway to an end of another vehicle.

13. A multi-car vehicle comprising:

a first car;

a second car, a gangway arranged between the first car and the second car;

wherein the gangway comprises:

a floor; and a sidewall;

wherein said sidewall comprises:

a central main panel having a front side and a back side;

a first side panel arranged to partially extend from a first side of the central main panel, the first side panel having a front side and a back side, a part of the front side of the first side panel being arranged facing the back side of the central main panel;

a second side panel arranged to partially extend from a second side of the central main panel, opposite to the first side of the central main panel, the second side panel having a front side and a back side, a part of the front side of the second side panel being arranged facing the back side of the central main panel; and at least one connection rod, wherein a first connection is provided that connects the connection rod to the back side of the first side panel;

a second connection is provided that connects the connection rod to the back side of the central main panel;

a third connection is provided that connects the connection rod to the back side of the second side panel;

wherein the gangway is attached to an end of the first car at a first gangway end, and attached to an end of the second car at a second gangway; and wherein a first vehicle mounting plate is provided at one side of the first side panel and a second vehicle mounting plate is provided at one side of the second side panel, and wherein a telescopic rod connects the first vehicle mounting plate to the second vehicle mounting plate.

* * * * *